United States Patent [19]

Kosiak

[11] 4,178,921

[45] Dec. 18, 1979

[54] TAPERED ROLLER PRESSURE RELIEF SUPPORT

[75] Inventor: Michael Kosiak, Minneapolis, Minn.

[73] Assignee: Medrest Corporation, Minneapolis, Minn.

[21] Appl. No.: 890,398

[22] Filed: Mar. 27, 1978

Related U.S. Application Data

[63] Continuation-in-part of Ser. No. 777,525, Mar. 14, 1977, abandoned, which is a continuation-in-part of Ser. No. 632,179, Nov. 17, 1975, Pat. No. 4,011,862, which is a continuation-in-part of Ser. No. 545,726, Jan. 31, 1975, abandoned.

[51] Int. Cl.[2] ..... A61H 11/00

[52] U.S. Cl. ..... 128/58

[58] Field of Search ..... 128/57, 58, 24.3, 33

[56] References Cited

U.S. PATENT DOCUMENTS

| | | | |
|---|---|---|---|
| 1,214,306 | 1/1917 | Hoard | 128/57 |
| 2,285,958 | 6/1942 | Wheelock | 128/57 |
| 2,310,106 | 2/1943 | Miller | 128/58 |
| 2,395,040 | 2/1946 | Curtis | 128/58 |
| 2,461,102 | 2/1949 | Ackerman | 128/57 |
| 3,128,761 | 4/1964 | Smith | 128/58 |
| 3,464,406 | 9/1969 | Kunce | 128/57 |
| 3,523,524 | 8/1970 | Wilson | 128/58 |
| 3,687,133 | 8/1972 | Grubelic | 128/58 |
| 3,835,844 | 9/1974 | Lang | 128/33 |

FOREIGN PATENT DOCUMENTS 1046900 7/1953 France .

*Primary Examiner*—Lawrence W. Trapp
*Attorney, Agent, or Firm*—Robert C. Baker

[57] ABSTRACT

The pressure relief support structure comprises a sheet-like flexible cover and a mechanical apparatus under the cover. The mechanical apparatus consists essentially of a frame, an endless belt assembly of tapered rollers, a pair of spaced track members for support of an upper stretch of the belt assembly, and means for moving the belt assembly to cause its tapered rollers to move in sequence along the upper stretch. Preferably, the tapered rollers are segmented into frusto-conical sections independently rotatable with respect to each other; and in addition, the track members are preferably contoured to allow a depression of at least a part of the upper stretch of the belt assembly.

31 Claims, 10 Drawing Figures

TAPERED ROLLER PRESSURE RELIEF SUPPORT

This application is a continuation-in-part of my abandoned application Ser. No. 777,525, filed Mar. 14, 1977, which was a continuation-in-part of my application Ser. No. 632,179, filed Nov. 17, 1975 (now U.S. Letters Pat. No. 4,011,862, issued March 15, 1977), which later was a contination-in-part of my abandoned application Ser. No. 545,726, filed Jan. 31, 1975.

This invention relates to an improved structure for support of a buttocks in a partially cradled and varied pressure manner to facilitate movement of blood through the buttocks tissues. The structure of this invention comprises a belt assembly of tapered rollers, preferably in combination with contoured track members. The most ideal tapered rollers are those segmented into frusto-conical sections independently rotatable with respect to each other.

Known prior art is set forth in the following United States Letters Patents, none of which provides the solution to buttocks support as taught herein: Hoard U.S. Pat. Nos. 1,214,306; Noble 1,322,720; Prien 2,052,656; Wheelock 2,285,958; Miller 2,310,106; Niblack 2,359,933; Curtis 2,395,040; Ackerman 2,461,102; Gaudette et al 2,543,493; Tarr 2,841,139; Kubicek 3,050,050; Smith 3,128,761; Kunce 3,464,406; Kilcup 3,480,007; Wilson 3,523,524; Madsen 3,587,569; Simjian 3,662,749; Laskowitz 3,675,644; Grubelic 3,687,133; and Lang 3,835,844. Also known and fully distinguished over is French Pat. No. 1,046,900, published Dec. 9, 1953.

My U.S. Pat. No. 4,011,862 (issued on my application Ser. No. 632,179, filed Nov. 17, 1975) claims apparatus of a more sophisticated and ideal nature for solving the problem noted herein; but the teachings herein provide apparatus of reduced weight which gives substantially effective results. A further benefit or advantage is that the teachings herein are relatively economical for adoption and use. Indeed, when rollers segmented into frusto-conical sections are employed as taught herein, very excellent results are obtained, since such segmented rollers permit differentials in the rates of rotation for portions of the roller members having different circumference measurements. Thus, portions of smaller circumference may rotate as much as necessary (and to a greater extent) as they roll under a buttocks, as compared to portions of relatively larger circumference.

Nature blesses the average individual with an excellent nervous system which prompts shifting of positions of rest rather frequently, whether one is lying down or in a sitting position. Shifts of position facilitate capillary blood movement through buttocks tissues and save one from the development of buttocks sores or ulcers. But paraplegics and others similarly afflicted are either incapable of shifting position or forget to do so because no nervous system warnings of discomfort are experienced.

The tissues of the buttocks, especially between bone structures of the buttocks area (such as the ischial tuberosities and sacrum) and the skin covering therefor, are normally very thin and severely compressed and starved of blood by the weight of a person who remains stationary on them while seated or while lying prone. But, according to this invention, the healthy movement of blood through capillaries of buttocks tissues to generate normal cellular metabolism is facilitated without a critical necessity for manually or otherwise shifting or elevating, or in any way noticeably moving, the person who is in a resting position. Optionally, the structure hereof may be adjusted to effect noticeable movement of the person on it; but such is not critically necessary when practicing the invention.

The improved structure of this invention provides support of a buttocks in a partially cradled and varied pressure manner to facilitate movement of blood through the buttocks tissues. The structure comprises a sheet-like flexible cover and a mechanical apparatus under the cover. The mechanical apparatus consists essentially of a perimeter frame, and an endless flexible belt assembly of roller members mounted in the frame. The roller members are tapered from each end thereof toward a smaller diameter at the medial portion thereof. They are preferably segmented into frusto-conical sections independently rotatable with respect to each other. A pair of spaced track members are provided for support of an upper stretch of the composite belt assembly. The track members are preferably contoured so as to support the upper stretch in a manner permitting the formation of a depression in the upper stretch. Also included is means for moving the composite belt assembly to cause the tapered rollers to move in sequence along the upper stretch.

The combination of the tapered roller members and a relatively depressed upper stretch portion serves to provide a partially cradled comfort support for a buttocks. The movement of the tapered roller members along the upper stretch effects a stroking action of alternate pressure and release of pressure to facilitate blood movement through buttocks tissues resting on the structure. Segmented rollers effectively provide this result without significant binding or pulling against the flexible cover and parts of an individual receiving the stroking action.

The invention will further be explained and described by reference to a drawing, made a part hereof, wherein.

Figure 7:
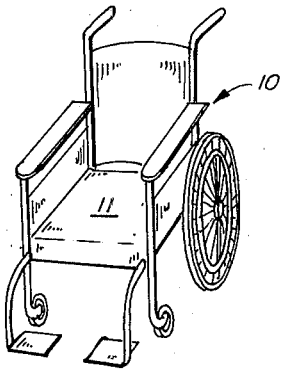
FIG. 7 is a schematic perspective view of a wheelchair equipped with a seat according to the invention.

Referring to FIG. 7, a chair of the invention may suitably, but not solely, take the form of a wheelchair 10, with its seat member 11 incorporating the teachings herein. Other chairs as well as discrete seat structures, without a backrest as a part thereof, may incorporate the teachings herein. Articles other than chairs may also incorporate the teachings herein. Mattresses are an excellent example; and the showing in FIG. 1 of the drawing is intended to be illustrative of a mattress as well as a seat member formed according to the invention. A common characteristic of both mattresses and seat members, as formed according to this invention, is that they will in all instances have a buttocks supporting structure as delineated herein.

Figure 1:
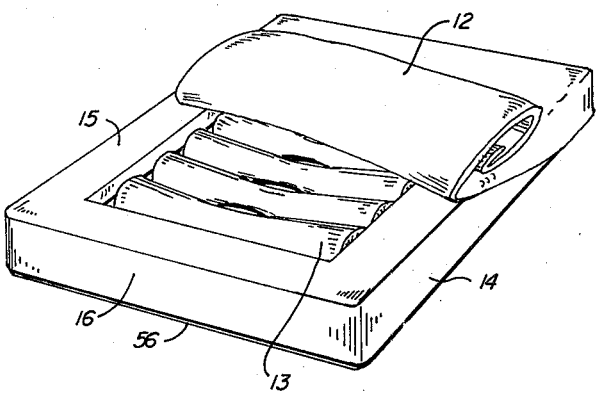
FIG. 1 is a schematic perspective view of a support structure (e.g., a seat member or mattress) according to this invention.

The buttocks supporting structure first comprises a flexible cover 12 or sheet or layer of material—such as a layer or cover of flexible plastic or leather or cloth. Thick padded cover materials are not desirably employed at the buttocks area, for they interfere with the effectiveness of the underlying mechanical apparatus in its selective application and release of pressure as hereinafter discussed. The underlying mechanical apparatus is identified broadly by the numeral 13 in FIG. 1. Edge portions outwardly adjacent the mechanical apparatus, or sometimes partially over it, are desirably equipped with a padded cushion strip (or a padded support structure of extensive area when a mattress is formed). Illustratively, at least three sides of the mechanical apparatus are shown in FIG. 1 to be equipped with such padded support material. Lateral side strips 14 and 15 and front strip 16 consists of such padded cushion material.

Figure 2:
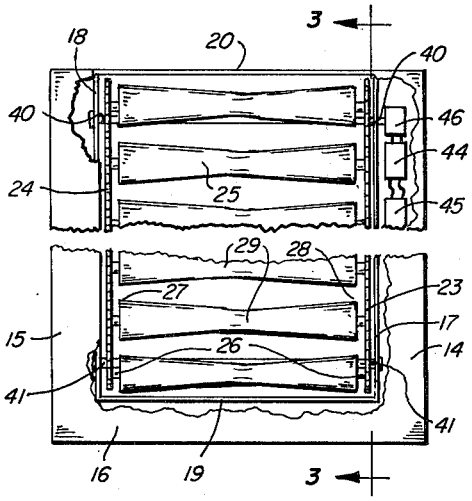
FIG. 2 is a schematic top plan view, partially broken away, of a structure according to FIG. 1, with the flexible cover removed to reveal the mechanical structure underneath.
Figure 3:
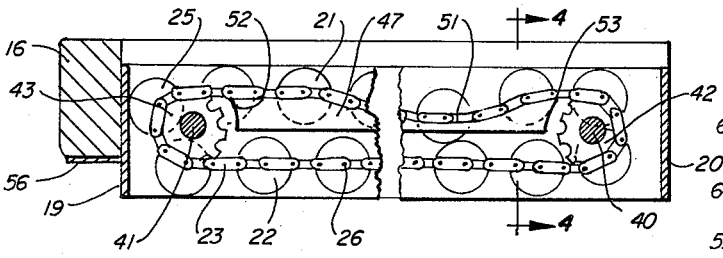
FIG. 3 is a schematic cross sectional view taken on line 3—3 of FIG. 2 and particularly illustrates the contour of the track or rail members and the arrangement of the tapered roller members.
Figure 4:
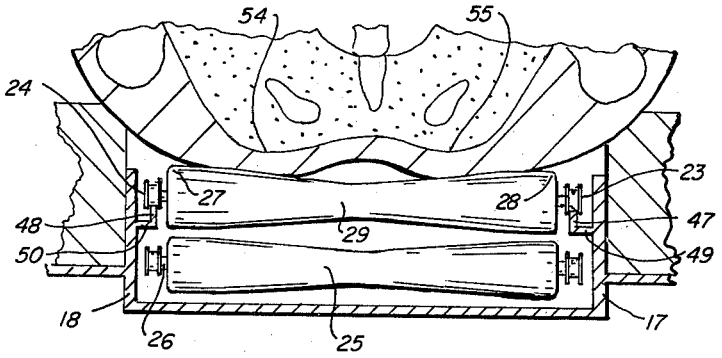
FIG. 4 is a schematic cross sectional view taken on line 4—4 of FIG. 3, with parts broken away or omitted for clarity of the showing, and with a section through a buttocks added.

Referring particularly to FIGS. 2, 3, and 4, the frame for the critical support structure of the invention suitably comprises girder members in the nature of panels or narrow strips of rigid material. These may be formed of plastic, wood, or metal; but aluminum is preferred. Illustratively, side girders 17 and 18 are united to a front (or base or foot) girder 19 and a back or rear (or top or head) girder 20 in any suitable manner to form a complete peripheral or perimeter frame. The perimeter frame may vary in size but is at least large enough to accommodate or receive the buttocks bone structures (such as ischial tuberosites or sacrum) within it. Edge cushions 14, 15, and 16 project slightly upwardly or above the top edges of the frame girder members, as illustrated in the drawing. The upward projection of the padded members 14, 15, and 16 provide a cushion support against flesh being pressed by its weight against the girders 17, 18, 19, and 20.

A single continuous or endless composite flexible belt assembly is mounted in the frame structure to provide an upper stretch 21 of the belt assembly (i.e., the portion immediately under the flexible cover 12) and a lower return stretch 22 of the belt assembly. The composite belt assembly includes a pair of spaced flexible endless base belts, such as chains 23 and 24, plus a plurality of roller members 25. Each roller member 25 has an axis pin or shaft, which at least forms a projection 26 at each end thereof; axis shaft projections 26 are the means by which the roller members 25 are mounted to endless base belts such as chains 23 and 24. The roller members 25 are mounted transversely and in substantially parallel relationship at intervals of spaced character between the endless base belts 23 and 24. Each roller member is mounted so as to be freely rotatable with respect to the base belts 23 and 24. Also, each roller is rotatable about its axis, which is identified in location by the axis shafts 26. Roller bearings at the shaft locations are useful to this end.

Referring particularly to FIG. 4, each roller 25 is tapered from the ends thereof, namely 27 and 28, toward the medial portion 29 thereof. The end diameters of the rollers are substantially the same for each and every roller throughout the composite flexible belt assembly. Medial diameters, that is the diameter of the rollers at the medial or central location between the ends, are in all cases substantially the same and are less than the end diameters (and optionally may be exceedingly small). Further, the tapering from the ends is circumferentially uniform, that is, entirely about the rollers and substantially uniform at all circumferential points equally distant from an end. The inward taper from the ends is such that an angle between 1° and 20° (preferably from about 2° or 3° up to about 8° or possibly 10°) is formed between the slope of the taper toward the medial portion of the roller and the shortest straight path or axis-parallel path from one end edge of the roller (e.g., the end circumferential point for the start of the slope) to the other end edge of the roller.

A proximate spaced relationship between roller members is preferred in that it gives an individual resting upon the roller members the sensation that he is supported by a platform even though there are spaces between the roller members. Generally, the width of spaces between roller members 25 will not normally be greater than approximately the end diameters of the roller members; but greater spacing may be employed where it is not objectionable if a person is subjected to noticeable up and down movement. Usually the spacing will be about that just sufficient to permit each roller to freely rotate without abutting against any adjacent roller at any point along the travel of the composite belt assembly.

For maximum benefit in terms of facilitating healthy blood movement, roller members 25 should be formed out of stiff or rigid materials (such as wood, metal, or hard plastics) in preference to resilient or soft materials. The end diameters of preferred roller members should be at least about one or two centimeters up to about four or five centimeters. Rollers of about three centimeters end diameter give excellent results in terms of comfort for a resting person and in terms of facilitating blood movement through buttocks tissues.

Figure 5:
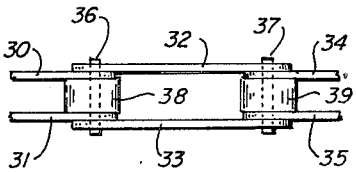
FIG. 5 is a schematic plan view showing features of an endless link chain useful for the invention.

The exact structural details for the laterally spaced flexible endless base belts 23 and 24 may vary. Illustratively, each may take the character of a link chain such as an ordinary bicycle chain. Each link (see FIG. 5) is separate and consists of two parts 30 and 31; 32 and 33; 34 and 35. The links of each pair overlap with adjacent pairs and are united by pins 36 and 37. A cylinder or spacing sleeve or enlargement 38 and 39 on each pin 36 and 37 serves to separate and connect the two parts of each link. Preferably, cylinders 38 and 39 exhibit little resistance to rotation about their pin axis, and serve as cooperating means for contact engagement with sprocket wheels and also rail members or tracks, as will be explained. Each tapered roller 25 is suitably fixed between endless chains 23 and 24 by extending the shaft of pin connectors (such as pins 36 and 37) and using the extended shafts as the axis pins or shafts 26 of the rollers.

Referring to FIGS. 2, 3, and 4, an illustrative non-limitative mounting will be discussed for the endless belt assembly within the frame members 17, 18, 19, and 20 so as to provide an upper stretch 21 of the rollers thereof and a return lower stretch 22 of such rollers. Where endless link chains 23 and 24 are employed as the spaced base belts of the composite belt assembly, they are suitably entrained about sprockets carried on shafts 40 and 41 near the rear 20 and front 19 members, respectively, of the frame. Shafts 40 and 41 are mounted for relatively free rotation in side girders 17 and 18. Illustratively, the endless chain 23 is shown in FIG. 3 to be entrained about sprockets 42 and 43. Chain 24 in entrained about comparable sprockets at the other end of shafts 40 and 41. As illustrated in the drawing, the sprocket wheels 42 and 43 are rigidly fixed to the shafts 40 and 41 so that rotation of one sprocket wheel will effectively cause rotation of the shaft carrying it as well as rotation of the other sprocket wheel (for chain 24) on that shaft. Further, the entraining of the endless link chains about the sprocket wheels effectively causes both shafts 40 and 41 to rotate when one is rotated. The power for the rotation of one when the other is rotated is transmitted through the endless link chains and the shafts 40 and 41.

Motive means for actuation of the movement of the sprockets and shafts and the endless belt assembly is schematically illustrated in FIG. 2. Power from a rapidly whirling small electrical motor 44, suitably energized by batteries in a battery recess 45, is fed through a gear speed reduction system 46 to shaft 40 which serves as the main drive shaft for effecting movement of the sprocket wheels (e.g., sprocket 42) and resulting movement of the chains 23 and 24 and the whole belt assembly of rollers 25. In the case of a mattress, or a seat member of fixed location relative to its immediate surroundings (e.g., a cab of a truck), electrical energy for operation of the motive means or motor 44 may be transmitted over power lines from a remote or at least a wholly separate source.

The gear reduction system 46 suitably slows the effective rate of movement of the endless belt assembly of rollers 25 to that which is barely perceptible. Little energy is required. Where battery sources are employed, they may be of the re-chargeable type, and reliable to effect operation for a full day or longer before requiring re-charging. A rate of movement as low as a centimeter per minute can be satisfactory to provide the blood movement results espoused herein. Even lower rates of movement may be satisfactory to save some persons from sores and ulcers as they remain essentially stationary in a resting position on the apparatus. Faster rates of movement are also possible (although usually unnecessary); and rates of movement as fast as a centimeter per half minute, or even a centimeter per second may be used with success (but with concomitant increase of power consumption, which makes excessively fast movement undesireable). Even intermittent movement may be employed, if desired. The movement of the composite belt assembly of rollers 25 is accomplished along the upper stretch 21 and is in all instances at least sufficient to effect a stroking action of alternate application and release of pressure on the buttocks of a resting person. This stroking action facilitates blood movement through the buttocks tissues resting on the support structure.

The movement of the belt assembly of rollers 25 along the upper stretch 21 is preferably not in a perfectly horizontal straight path. That movement along the upper stretch is horizontally oriented, but is contoured to provide a "bucket seat" effect.

As shown particularly in FIGS. 3 and 4, a rail or track member 47 provides an underlying support for the stretch of endless chain or base belt 23 extending from rear sprocket 42 to front sprocket 43. An identical (mirror image) rail or track member 48 provides an underlying support for the stretch of endless chain or base belt 24 extending along the upper stretch between the rear and front sprockets at the side of the support member where chain 24 is located. Since, as aforenoted, the axis pins 26 may be extensions of the pin members 36 and 37 of the endless chains, the track members 47 and 48 also serve to provide support for the axis pins 26 (and the roller members which they carry) of at least those of the upper stretch roller members 25 intermediate the front and rear ends of the upper stretch 21 of the belt assembly.

The pair of horizontally oriented track members 47 and 48 are mounted within the perimeter frame of girders 17, 18, 19, and 20. Tracks 47 and 48 are in parallel relationship to each other and are laterally spaced sufficiently to accommodate the roller members 25 as transverse elements between them. Any suitable arm members 49 and 50 may extend from side girders 17 and 18 for support of the track members 47 and 48 adjacent the side girders. If desired, track members 47 and 48 may be molded or shaped as structures unitary with the side girders.

Each track 47 and 48 is contoured to form a relatively depressed portion between the front and rear ends thereof. This contour for track 47 is illustrated in FIG. 4; and the contour for track 48 is a mirror image. The depressed portion of the tracks (e.g., the portion 51 between ends 52 and 53 for track 47 in FIG. 3) allows the rollers 25 along the upper stretch 21 to be likewise depressed at that portion of the upper stretch. Such depression of the rollers occurs at least when the buttocks weight presses thereon. In the case of a seat member, the location of the depressed portion is at approximately the portion which receives the buttocks ischial tuberosities 54 and 55 of a person seated on the seat member. Comparably, in the case of a mattress, the location is that of the buttocks area for a person lying on his back. The combination of the tapering for the rollers, plus the depressed portion, serves to provide a partially cradled comfort support for the buttocks.

One might expect that the thighs of an individual resting on the support structure hereof would be urged together by the tapered rollers thereunder in the portion of the thighs adjacent the buttocks. However, the soft padded area 16 supports lower thigh areas (or leg areas where the padded area 16 is enlarged and part of a mattress), and this contributes to a contrary effect. It serves as a friction element on which the thighs (or legs in the case of a mattress) rest lightly but sufficiently to oppose the effect of the tapered rollers in urging the thighs together. The combination of elements provides a comfortable net effect with significant economy of elements and consequent economy of manufacture and maintenance.

To be noted is that the mounting of the composite belt assembly at its base belts or endless chains 23 and 24 on the sprockets (e.g., sprockets 42 and 43 for chain 23) is not in a taut condition. The non-taut condition is just sufficient to allow the composite belt assembly to flex and move along the support path provided by the upper edges of contoured tracks 47 and 48.

The taper of the roller members 25, even though it may be as little as 1 or 2 degrees as aforenoted, gives a pronounced effect in terms of contributing to capillary blood flow and distributing body weight away from the thinnest tissue areas of a buttocks which are directly under the bone structures of a resting individual (such as the ischial tuberosities or hip bone or sacrum). The resulting support which is slightly along the sides of the buttocks is within the comfort range for a person not suffering from nerve insensitivity. Thus, the seat member hereof is also useful for truckers and others whose occupation requires long periods of remaining in a seated condition. Mattresses formed using the teachings herein, while especially useful for those suffering from nerve insensitivity, are also useful for the support of burn victims or others undergoing treatments or suffering from a condition impairing comfortable self movement.

Preferably, the movement of the roller members 25 along the upper stretch 21 is accomplished in a direction toward the heart of a person resting on the apparatus. Thus, in the case of a seat member, movement is from the front to the back of the seat; in the case of a mattress, movement is from foot to head. Movement in the reverse direction for that upper stretch, while not normally preferred, may nevertheless be employed, and may even be desirable under special or unusual circumstances, or for cleaning of the mechanical apparatus.

The actuation of movement of the composite belt assembly may suitably be accomplished in response to the weight of a person resting on the support structure. Specifically, a pressure actuated switch (e.g., arranged as taught in my U.S. Pat. No. 4,011,862) may complete the circuit for the flow of electricity to motor 44 for actuation of the movement. The padded areas 14, 15, and 16 suitably may be mounted on shelf members (such as shelf 56 in FIG. 3) which extend outwardly from girder elements of the perimeter frame.

If desired, the medial portion of the tapered rollers may be extremely small in diameter in the portion thereof adapted to be bridged by the ischial tuberosities or occupied by the sacrum of an individual resting on the support structure. Thus, as shown in FIG. 6, the medial portion of tapered rollers 57 may be grooved to a smaller diameter 58 than that which would obtain or arise solely as a result of a continuation of the tapering into that medial portion.

Figure 6:
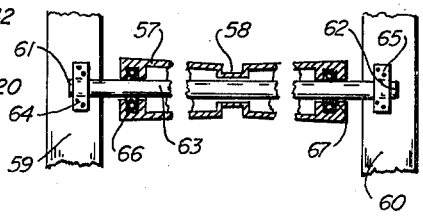
FIG. 6 is a schematic cross sectional view, partially broken away, through an alternative roller member, and additionally illustrates a schematic elevational view of alternate base belts and means for mounting roller members between the same.

Also illustrated in FIG. 6 is an alternate base belt arrangement for the composite belt assembly of the mechanical apparatus. The pair of laterally spaced flexible endless base belts 59 and 60 may consist essentially of an endless flexible strip or band of material. That endless flexible strip material may be a webbed material, or a fabric-reinforced rubbery or other plastics-type material. It may consist of a flexible continuous or endless metal band. It may have a V-shape in cross section so as to ride within the groove of a pulley or like structure used to replace the sprocket wheels of FIG. 3 when a flexible strip material of V-shape is employed as a substitute for the link chains specifically illustrated in FIG. 3. Where the band or strip material is substantially flat in character, pulleys of substantially uniform or flattened rim character should replace the sprocket wheels of FIG. 3. Friction surfacing on the pulleys may be desirable; and for this purpose a rubbery coating or a non-slip surfacing may be employed.

The projecting ends 61 and 62 of the axis shaft 63 for roller 57 are suitably fixed to a band or flexible strip base belt by means of brackets 64 and 65 riveted to the strip material. The tapered roller members are suitably mounted on the axis shafts with roller bearing race arrangements 66 and 67 so that the tapered rollers are freely rotatable for rolling movement under the cover 12 as they pass along the upper stretch. Any suitable means (e.g., lateral roller bearing race arrangements against the ends of the tapered rollers) may be used to limit the lateral shift of the tapered rollers on the axis shaft 63.

Figure 8:
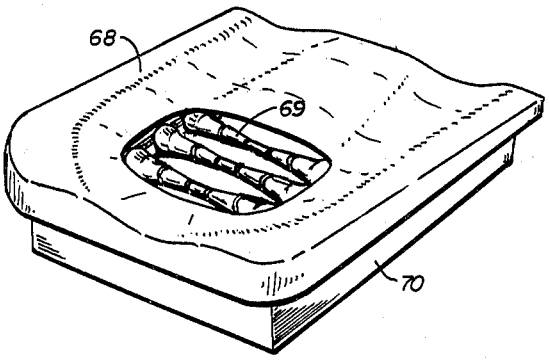
FIG. 8 is a schematic perspective view of an alternative support structure of the invention, with the flexible cover therefor omitted, and illustrates a form of apparatus especially useful as a seat structure.

As shown in FIG. 8, a resilient ellipsoidal support 68 may be placed over perimeter portions of the underlying tapered roller mechanical apparatus. The support 68 may be formed of expanded or foamed plastic or rubbery material (e.g., foamed polyurethane), and is preferably contoured to form a seat providing a comfortable relationship for one's thighs and the side areas of one's buttocks. An opening of elliptical nature in support 68 is adapted to receive the buttocks, particularly the ischial tuberosity area, for stroking action by the tapered rollers 69 of the underlying mechanical apparatus 70. The contours of resilient ellipsoidal support 68 contributes to a "bucket seat" effect even when the horizontally oriented path of the upper stretch of tapered rollers 69 is level, i.e., without any depressed portion. Of significance is the fact that a seat structure as shown in FIG. 8 concentrates the stroking action of the support structure at the exact area where it is needed (i.e., on the ischial tuberosity area), and also provides comfort for the thigh area where there is an adequate amount of soft tissue of the type which does not have a great tendency to break down in the manner characteristic for the thin tissue area of the ischial tuberosities.

Figure 9:
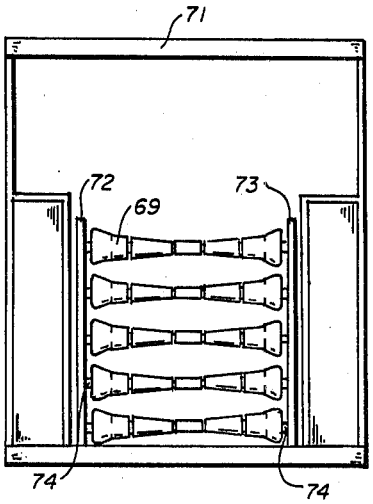
FIG. 9 is a schematic top plan view of an alternative style for the underlying mechanical apparatus useful for various embodiments of the invention but particularly useful as part of the seat structure of FIG. 8.

Mechanical apparatus for a seat structure such as illustrated in FIG. 8 preferably takes the form illustrated in FIG. 9. The mechanical apparatus of FIG. 9 is analogous to that earlier described with reference to FIGS. 1–6, inclusive, except for two significant features. The first is the fact that a relatively short span of tapered rollers 69 is employed (and correspondingly, there is a relatively large void space between one end of the span and the front girder 71 of the perimeter frame). The second is that the tapered rollers 69 are segmented. In all other respects, the elements making up the mechanical apparatus of FIG. 9 are analogous to those most particularly shown in FIG. 2 and described hereinbefore. Thus, the apparatus of FIG. 9 has the endless flexible composite belt assembly with its pair of endless base belts 72 and 73. Between those base belts are mounted a plurality of axis shafts 74, all in substantially parallel relationship.

Figure 10:
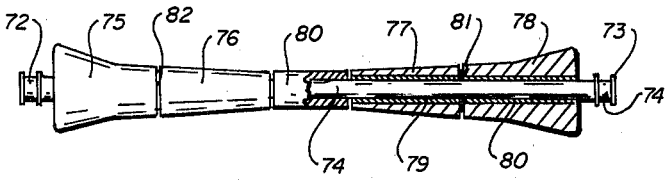
FIG. 10 is a schematic plan view, partially in cross section, of preferred segmented tapered rollers of the invention.

The special segmented rollers 69 of FIG. 9 will be described by reference to FIG. 10. Each is mounted on a straight axis shaft 74 which in turn is mounted at each end on a base belt 72 and 73. Each roller member is segmented into a plurality of frusto-conical sections 75, 76, 77, and 78. Usually at least four frusto-conical sections are employed (two on each side). A multitude of such sections may be used, but more than 8 or 10 are unnecessary. Each frusto-conical section is independently rotatable on the shaft 74. To this end sleeves 79 and 80 may be inserted as bearing members, if desired, between shaft 74 and a frusto-conical section. Illustratively, sleeves of "Teflon" (polytetrafluoroethylene) or other plastics type material may be employed, and advantageously exhibit self-lubricating properties contributing to free rotation for the frusto-conical sections. The medial section 80 also is rotatable, may suitably be formed of "Teflon", but may be of such decreased diameter and of such short length that a high degree of free rotation for it is relatively less significant. If desired, a bearing washer 81 and 82, of "Teflon" or other plastics type material, may be inserted between frusto-conical sections to promote free rotation. Most preferred, however, are frusto-conical sections formed entirely of plastics type material; and to this end, polyamides of the "Nylon" type are useful. When plastic frusto-conical sections are employed, separate bearing washers and sleeves are unnecessary to gain free independent rotation of the parts. It will, of course, be evident that roller bearings may be employed, if desired; but they are wholly unnecessary.

The tapered rollers, preferably segmented, may optionally be provided with a relatively sharp or greater angle of taper near their ends as compared to their angle of taper at inward locations toward and next to their medial portion. Thus, the taper next to the medial portion may be less than that nearest the opposite ends of the roller members. In all cases, however, all roller members of a composite belt assembly should be substantially identical.

While this invention has been described with particular reference to varied structural details as illustrated in the drawing, it is to be recognized that other variations from those specifically illustrated are possible without departing from the essential character of the invention as set forth in the appended claims.

That which is claimed is:

1. A structure for support of a buttocks in a partially cradled and varied pressure manner to facilitate movement of blood through the buttocks tissues, said structure comprising a sheet-like flexible cover and a mechanical apparatus under said cover, said mechanical apparatus consisting essentially of (i) a horizontally-oriented perimeter frame having front, rear, and side members;

(ii) a single endless flexible composite belt assembly consisting essentially of a pair of laterally spaced flexible endless base belts, a plurality of discrete roller members, an axis shaft projection from each end of each said roller member, and means for mounting said roller members through said axis shaft projections to said base belts, with said roller members in substantially parallel relationship between said base belts and freely rotatable with respect to said base belts, each said roller member being tapered from each end thereof toward the medial portion thereof, all ends of said roller members being substantially the same in diameter, all medial portions of said roller members being substantially the same in diameter but of a lesser diameter than at said ends, said taper of each said roller member being substantially circumferentially uniform and at an angle between 1° and 20° from a straight axis-parallel path between the ends of the roller member, said composite belt assembly being mounted in said frame to provide an upper stretch of said roller members under said flexible cover and a lower return stretch of said roller members, (iii) a pair of horizontally-oriented track members mounted within said frame on said side members of said frame, said track members being laterally spaced to accommodate said roller members as transverse elements therebetween as said composite belt assembly is mounted in said frame, said track members providing support for said axis shaft projections of at least those of said upper stretch roller members intermediate the front and rear ends of said upper stretch, said track members being contoured to form a relatively depressed portion thereof at a location between the front and rear ends of said upper stretch, said relatively depressed portion being such as to allow said roller members at said portion of said upper stretch to be depressed relatively to end rollers of said upper stretch, the combination of said tapered roller members and said relatively depressed portion serving to provide a partially cradled comfort support for a buttocks, and (iv) means for moving said composite belt assembly to cause said roller members thereof to move in sequence along said upper stretch, thereby to effect a stroking action of alternate pressure and release of pressure to facilitate blood movement through buttocks tissues resting on said structure.

2. The structure of claim 1 wherein said angle of taper for said roller members is between 2° and 10°.

3. The structure of claim 1 wherein said upper stretch of said composite belt assembly is not taut as mounted in said frame.

4. The structure of claim 1 wherein said medial portion of said roller members is grooved to a smaller diameter than that which would obtain solely as a result of continuation of said taper into said medial portion.

5. The structure of claim 1 wherein said belts consist essentially of chains made up of rigid links.

6. The structure of claim 1 wherein said base belts consist essentially of flexible continuous strip material.

7. The structure of claim 1 in the form of a seat member and additionally comprising padded support members outwardly adjacent at least the front and side members of said perimeter frame.

8. The structure of claim 7 wherein said medial portion of said roller members is grooved to a smaller diameter than that which would obtain solely as a result of continuation of said taper into said medial portion.

9. The structure of claim 1 in the form of a mattress for a bed and additionally comprising padded support material outwardly from said perimeter frame.

10. The structure of claim 9 wherein said medial portion of said roller members is grooved to a smaller diameter than that which would obtain solely as a result of continuation of said taper into said medial portion.

11. The structure of claim 1 wherein each said roller member is segmented into frusto-conical sections independently rotatable with respect to each other.

12. A structure for support of a buttocks in a partially cradled and varied pressure manner to facilitate movement of blood through the buttocks tissues, said structure comprising a sheet-like cover and a mechanical apparatus under the cover, said mechanical apparatus consisting essentially of a perimeter frame, an endless flexible composite belt assembly of roller members mounted in said frame, said roller members being tapered from each end thereof toward a smaller diameter at the medial portion thereof, a pair of spaced contoured track members for support of an upper stretch of said composite belt assembly in a manner for forming a depression in said upper stretch, and means for moving said composite belt assembly to cause the tapered roller members thereof to move in sequence along said upper stretch.

13. The structure of claim 12 wherein each said roller member is segmented into frusto-conical sections independently rotatable with respect to each other.

14. A structure for support of a buttocks in a partially cradled and varied pressure manner to facilitate movement of blood through the buttocks tissues, said structure comprising a sheet-like flexible cover and a mechanical apparatus under the cover, said mechanical apparatus consisting essentially of a perimeter frame, an endless flexible composite belt assembly of roller members mounted in said frame, said roller members being tapered from each end thereof toward a smaller diameter at the medial portion thereof and being segmented into frusto-conical sections independently rotatable with respect to each other, a pair of spaced track members for support of an upper stretch of said composite belt assembly, and means for moving said composite belt assembly to cause the tapered roller members thereof to move in sequence along said upper stretch.

15. The structure of claim 14 wherein said track members are contoured to form a relatively depressed portion thereof at a location between the ends of said upper stretch, said relatively depressed portion being such as to allow the roller members of said composite belt assembly to be depressed relatively to end roller members of said upper stretch.

16. The structure of claim 14 wherein said taper of said roller members is substantially circumferentially uniform and at an angle between 1° and 20° from the axis of rotation thereof.

17. A structure for support of a buttocks in a partially cradled and varied pressure manner to facilitate movement of blood through the buttocks tissues, said structure comprising a sheet-like flexible cover and a mechanical apparatus under said cover, said mechanical apparatus consisting essentially of:

(i) a horizontally-oriented perimeter frame having front, rear, and side members;

(ii) a single endless flexible composite belt assembly consisting essentially of a pair of laterally spaced flexible endless base belts, a plurality of axis shafts in substantially parallel relationship between said base belts and mounted on said base belts, a roller member mounted on each said axis shaft, each said roller member being tapered from each end thereof toward the medial portion thereof and being segmented into frusto-conical sections independently rotatable with respect to each other, all ends of said roller members being substantially the same in diameter, all medial portions of said roller members being substantially the same in diameter but of a lesser diameter than at said ends, said taper of each said roller member being substantially circumferentially uniform and at an angle between 1° and 20° from a straight axis-parallel path between the ends of the roller member, said composite belt assembly being mounted in said frame to provide an upper stretch of said roller members under said flexible cover and a lower return stretch of said roller members, (iii) a pair of horizontally-oriented track members mounted within said frame on said side members of said frame, said track members being laterally spaced to accommodate said roller members as transverse elements therebetween as said composite belt assembly is mounted in said frame, said track members providing support for said axis shafts of at least those of said upper stretch roller members intermediate the front and rear ends of said upper stretch, and (iv) means for moving said composite belt assembly to cause said roller members thereof to move in sequence along said upper stretch, thereby to effect a stroking action of alternate pressure and release of pressure to facilitate blood movement through buttocks tissues resting on said structure.

18. The structure of claim 17 wherein said angle of taper for said roller members is between 2° and 10°.

19. The structure of claim 17 wherein said upper stretch of said composite belt assembly is not taut as mounted in said frame.

20. The structure of claim 17 wherein said medial portion of said roller members is of a smaller diameter than that which would obtain solely as a result of continuation of said taper into said medial portion.

21. The structure of claim 17 wherein said belts consist essentially of chains made up of rigid links.

22. The structure of claim 17 wherein said base belts consist essentially of flexible continuous strip material.

23. The structure of claim 17 in the form of a seat member and additionally comprising padded support members outwardly adjacent at least the front and side members of said perimeter frame.

24. The structure of claim 23 wherein said medial portion of said roller members is grooved to a smaller diameter than that which would obtain solely as a result of continuation of said taper into said medial portion.

25. The structure of claim 17 in the form of a mattress for a bed and additionally comprising padded support material outwardly from said perimeter frame.

26. The structure of claim 25 wherein said medial portion of said roller members is grooved to a smaller diameter than that which would obtain solely as a result of continuation of said taper into said medial portion.

27. The structure of claim 17 wherein said taper of said roller members next to the medial portion thereof is less than said taper nearest the opposite ends thereof.

28. The structure of claim 17 additionally comprising bearing washers between frusto-conical section of said roller members.

29. The structure of claim 17 additionally comprising self-lubricating sleeve bearings on said axis shafts for free rotation of frusto-conical sections of said roller members.

30. The structure of claim 17 additionally comprising a resilient ellipsoidal support over perimeter portions of said mechanical apparatus, said ellipsodial support being adapted to support thigh tissues thereupon and being adapted to receive a buttocks within the elliptical opening thereof for stroking action by said mechanical apparatus.

31. The structure of claim 17 wherein said track members are contoured to form a relatively depressed portion thereof at a location between the ends of said upper stretch, said relatively depressed portion being such as to allow the roller members of said composite belt assembly to be depressed relatively to end roller members of said upper stretch.

* * * * *